US011585049B2

(12) United States Patent
Schuette

(10) Patent No.: US 11,585,049 B2
(45) Date of Patent: Feb. 21, 2023

(54) OVERLOAD SUPPORT SYSTEM FOR A PAVING MACHINE SCREED ASSEMBLY

(71) Applicant: Caterpillar Paving Products Inc., Brooklyn Park, MN (US)

(72) Inventor: Ryan Schuette, Saint Michael, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 582 days.

(21) Appl. No.: 16/554,062

(22) Filed: Aug. 28, 2019

(65) Prior Publication Data

US 2021/0062439 A1 Mar. 4, 2021

(51) Int. Cl.
*E01C 19/48* (2006.01)
*E01C 19/23* (2006.01)

(52) U.S. Cl.
CPC ..... *E01C 19/488* (2013.01); *E01C 19/23* (2013.01)

(58) Field of Classification Search
USPC ..... 404/85, 86, 118
See application file for complete search history.

(56) References Cited

U.S. PATENT DOCUMENTS 3,557,672 A * 1/1971 Shurtz ..... E01C 19/4873 404/95
3,880,542 A 4/1975 Mullen
3,901,616 A * 8/1975 Greening ..... E01C 19/4873 404/85
4,470,783 A * 9/1984 Friebel ..... E04G 21/10 404/85
5,238,323 A * 8/1993 Allen ..... E04F 21/247 404/112
6,193,437 B1 2/2001 Heims
6,712,549 B2 * 3/2004 Roth ..... B62D 55/104 404/83
7,497,641 B1 * 3/2009 Frelich ..... E01C 19/48 172/611
7,771,139 B2 * 8/2010 Grahl ..... E04F 21/247 404/112
8,025,458 B2 * 9/2011 Musil ..... E01C 19/48 404/85
9,028,168 B1 * 5/2015 Knapp ..... E01C 7/00 404/85
2012/0282026 A1 * 11/2012 Atherton ..... E01C 19/4866 404/82
2017/0367266 A1 * 12/2017 Vandendriessche ..... A01D 41/144
2019/0320585 A1 * 10/2019 Jongmans ..... A01D 41/14
2020/0095736 A1 * 3/2020 Wiktor ..... B60G 17/056

FOREIGN PATENT DOCUMENTS

EP 2 537 982 B1 4/2015
JP 3331427 B2 10/2002
WO WO2017211458 A1 12/2017
WO WO2018115098 A1 6/2018

* cited by examiner

*Primary Examiner* — Gary S Hartmann
(74) *Attorney, Agent, or Firm* — Harrity & Harrity LLP

(57) ABSTRACT

A screed assembly, for a paving machine, may include a frame, a main screed and a screed plate. Additionally, the screed assembly may include an overload support system mounted on the screed assembly. Further, the overload support system may be configured to contact the surface extending beneath the screed assembly and to support the screed assembly during transport on the surface.

9 Claims, 5 Drawing Sheets

OVERLOAD SUPPORT SYSTEM FOR A PAVING MACHINE SCREED ASSEMBLY

TECHNICAL FIELD

The present disclosure generally relates to paving machines having a screed assembly and, more particularly, relates to systems and methods for supporting the weight of a paving machine screed assembly.

BACKGROUND

When constructing roads, bridges, parking lots and other such surfaces, paving machines may be used to deposit, spread and compact paving material, such as asphalt, on a base surface, thereby creating a flat, consistent surface over which vehicles will travel. A paving machine generally includes a tractor portion having a chassis and a hopper for storing the paving material, an auger that distributes the paving material on a base surface and a screed assembly that levels and compacts the paving material, ideally leaving a mat of uniform depth and smoothness. The screed assembly is typically rear-mounted on the paving machine behind the hopper, the chassis and the auger relative to the direction of travel. Further, the screed assembly is typically drawn behind the paving machine by a pair of pivotally mounted tow arms.

Among other things, the screed assembly may include a main screed and one or more extension screeds mounted behind (or in front of) the main screed. The extension screeds are laterally extendable from the main screed to adjust for varying base surface widths. In addition, the main screed and the extension screeds may each include bottom-facing screed plates that facilitate the compacting and leveling of the paving material on the base surface. Further, screed assemblies may include other components and systems, such as, leveling arms, vibrators, tamper bars, shimming plates, side plates, hydraulic cylinders, stairs, walkways, sensors, controllers, as well as additional components known to those skilled in the art.

These many screed assembly components contribute to the relatively heavy weight of screed assemblies. Because of the substantial weight of the screed assembly, the paving machine may have a significant weight imbalance between its front and rear ends. Such an imbalance may adversely affect the stability and steering of the paving machine. Therefore, while the paving machine may be able to lift and tow the screed assembly during a typical paving operation, any road travel or relocation of the paving machine and screed assembly independent of a paving operation may be difficult, if not impossible. Ballast counterweight has typically been used to address this problem. Specifically, ballast counterweight may be mounted to the front end of a paving machine to offset the heavy weight of the rear mounted screed assembly. However, while ballast counterweight may help to equilibrate the machine's front/rear weight imbalance, its utilization is cumbersome and adds significant weight to an already overburdened paving machine.

Alternatively, European Patent No. 2537982 addresses this problem by disclosing a screed supporting carriage having a large frame on which the entirety of the screed assembly is received, the frame having wheels attached thereto. The disclosed carriage includes a draw bar and trailer hitch for transporting the carriage to the paving machine. Further, the carriage includes a coupling device for attaching the carriage to the chassis of the paving machine, which pulls the carriage beneath the screed assembly during road travel. While such a carriage may provide support for the screed assembly during travel, an independent vehicle to which the draw bar/trailer hitch is attached is required for transporting the large carriage to the paving machine, between worksites, or otherwise. Moreover, the relatively complex structure of the carriage, combined with the overload weight carried thereby, likely demands regular maintenance. Therefore, additional time and equipment are required at the paving worksite in order to outfit a paving machine with such a support carriage, thereby decreasing the efficiency of the paving operation and of the transport of the paving machine.

The disclosed overload support systems and methods for a paving machine screed assembly are directed to overcoming one or more of the problems set forth above and/or other problems of the prior art.

SUMMARY

In accordance with one aspect of the present disclosure, a screed assembly for a paving machine is disclosed. The disclosed screed assembly may include an overload support system mounted on the screed assembly. Further, the disclosed overload support system may be configured to contact the surface extending beneath the screed assembly and to support the screed assembly during transport on the surface.

In accordance with another aspect of the present disclosure, an overload support system for a screed assembly of a paving machine is disclosed. The overload support system may include at least one arm configured to attach to the screed assembly and extend from the screed assembly. The overload support system may also include at least one rotatable member attached to the arm. Further, the rotatable member may be configured to contact the surface extending beneath the screed assembly and support the screed assembly during transport on the surface.

In accordance with another aspect of the present disclosure, a method of transporting a paving machine having a screed assembly is disclosed. The disclosed method may include the step of mounting an adjustable overload support system to the screed assembly, the overload support system configured to be maintained in a raised position during paving operations. In addition, the disclosed method may include the step of arranging the overload support system in a lowered position to contact the surface extending beneath the screed assembly and to support the screed assembly on the surface. Further, the disclosed method may include the step of transporting the paving machine on the surface with the overload support system maintained in the lowered position.

These and other aspects and features of the present disclosure will be better understood when read in conjunction with the accompanying drawings.

While the following detailed description will be given with respect to certain illustrative embodiments, it should be understood that the drawings are not necessarily to scale and the disclosed embodiments are sometimes illustrated diagrammatically and in partial views. In addition, in certain instances, details which are not necessary for an understanding of the disclosed subject matter or which render other details too difficult to perceive may have been omitted. It should therefore be understood that this disclosure is not limited to the particular embodiments disclosed and illustrated herein, but rather to a fair reading of the entire disclosure and claims, as well as any equivalents thereto.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Although the presently disclosed overload support systems are shown in operative association with the screed assembly of a paving machine, it should be understood that the overload support systems may be incorporated where needed on any suitable mobile work machine. The machine may be any machine that performs operations associated with an industry such as construction, farming, mining or any other industry known in the art.

Figure 1:
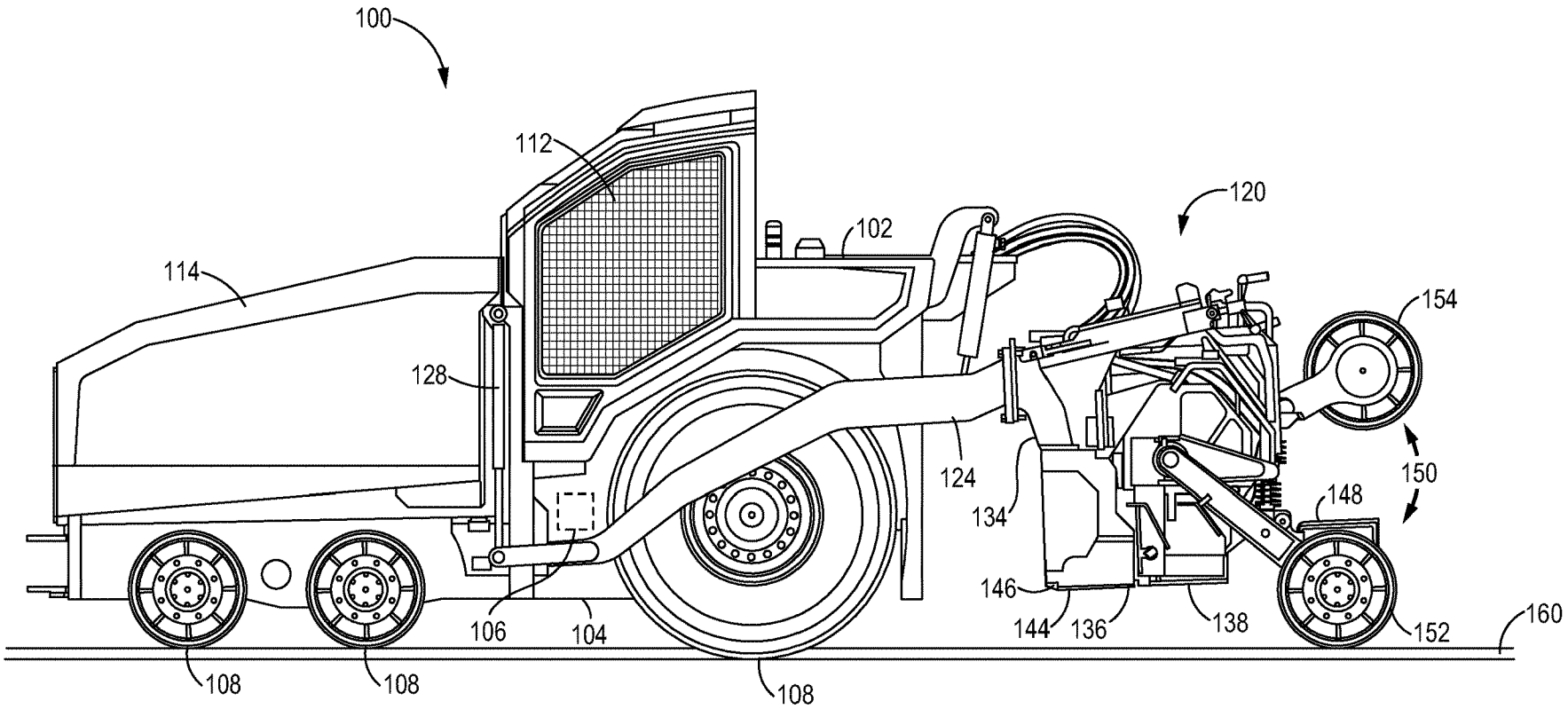
FIG. 1 is a side view of a paving machine having an exemplary overload support system for a screed assembly, in accordance with the present disclosure.
Figure 2:
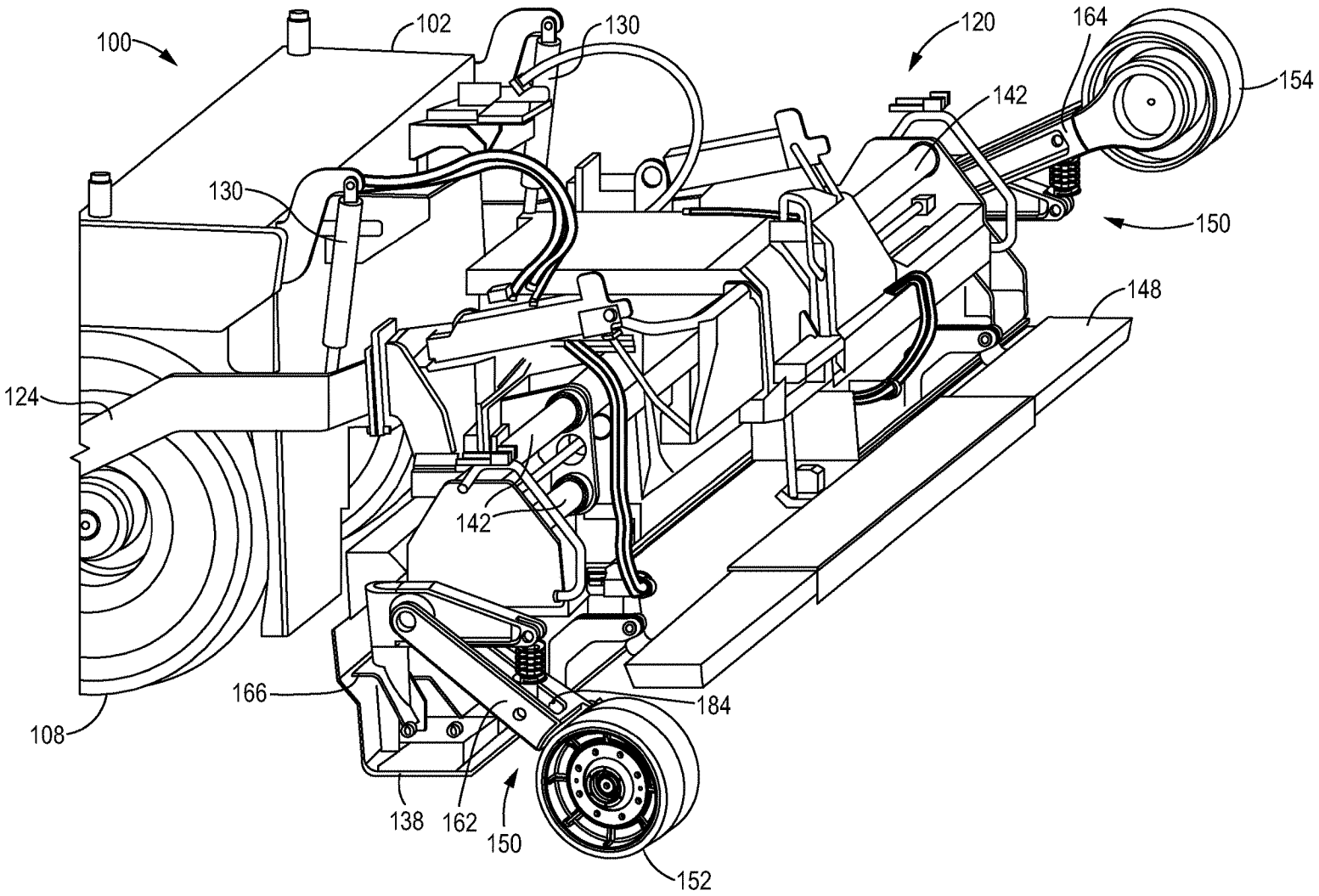
FIG. 2 is a partial perspective view of the paving machine of FIG. 1 having an exemplary overload support system for a screed assembly.

FIGS. 1 and 2 illustrate one example of a paving machine 100 that incorporates features of the present disclosure. The paving machine 100, which may also be referred to as an asphalt paver, may be any machine used to distribute a layer of paving material on the surface of a roadway or other area. The paving machine 100 includes a tractor portion 102 having a machine frame 104, a power source 106, such as a gas turbine engine, a gas or diesel internal combustion engine, a motor or the like, and a plurality of traction devices 108. The traction devices 108 may be operatively coupled to the power source 106 by a transmission mechanism (not shown) to drive the traction devices 108 and propel the paving machine 100. Although, the traction devices 108 are shown in the figures as wheels, the traction devices 108 could alternatively be tracks or any other type of traction devices. The traction devices 108 could also be combinations of different types of traction devices. For example, the paving machine 100 could include both tracks and wheels. The paving machine 100 may also include an operator station 112 configured to provide operator control over the paving machine 100. The operator station 112 may include therein one or more operator seats and an operator interface (not shown). In one embodiment, the operator station 112 may be mounted to the frame 104 proximal to the rear of the frame 104.

A hopper 114 may be positioned at the front of the paving machine 100 and may contain the paving material that is to be formed into a mat on the base surface. The paving material may be dumped into the hopper 114 from trucks that deliver the paving material to a worksite. The paving machine 100 may also include one or more conveyors (not shown) at the bottom of the hopper 114. The conveyors transport the paving material from the hopper 114 to the rear of the tractor portion 102. The paving machine 100 may further include one or more augers (not shown) or other material feed components instead of or in addition to the conveyors. The augers distribute the paving material in front of a screed assembly 120 positioned at the rear end of the tractor portion 102. As the paving machine 100 travels forward, the paving material is evenly spread and compacted by the screed assembly 120. In the disclosed example, the paving machine 100 is self-powered by way of the tractor portion 102. It is contemplated, however, that the tractor portion 102 may alternatively be omitted, and the hopper 114 and/or screed assembly 120 towed by another machine (e.g., a dump truck), if desired.

The screed assembly 120 is attached to the tractor portion 102 by tow arms 124 (only one of which is visible in FIG. 1) and towed behind the tractor portion 102 to spread and compact the paving material into a layer or mat of desired thickness, width and uniformity. The tow arms 124 are pivotally connected to the frame 104 such that the relative position and orientation of the screed assembly 120 relative to the frame 104 and to the surface being paved may be adjusted by raising or lowering the tow arms 124 via actuators 128. Moreover, screed lift cylinders 130, which may vary the downward force applied to the screed assembly 120, may provide further control over the paving process. The tow arm actuators 128, as well as the screed lift cylinders 130, may be any suitable actuators, for example, hydraulic cylinders.

The screed assembly 120 may have any of a number of configurations known in the industry. FIGS. 1 and 2 illustrate an exemplary screed assembly 120. As shown in FIGS. 1 and 2, the screed assembly 120 may be a compilation of components that cooperate to shape, level, and compact an asphalt mixture delivered from the hopper 114 onto a base surface. The screed assembly 120 components may include a main frame 134, a main screed 136 and one or more extension screeds 138 that extend laterally from the main screed 136 when in use. The main frame 134 of the screed assembly 120 may be operatively connected to the paving machine frame 104 via the two tow arms 124. The extension screeds 138 may be moved in-and-out relative to main screed 136 by way of one or more hydraulic rams 142, so as to adjust a width of the resulting layer of asphalt laid down by screed assembly 120. The extension screeds 138 may be located immediately adjacent main screed 136, in front of main screed 136, or behind main screed 136 (as shown in FIG. 1) relative to a normal forward traveling direction of the paving machine 100. Further, the extension screeds 138 may be electrically or hydraulically actuated by the operator of the paving machine 100 to extend and retract as needed for a particular paving job. It should be noted, however, that in other embodiments the extension screeds may be omitted.

The main screed 136 may include a main screed plate 144. In operation, the main screed plate 144 will smooth and compress paving material as the screed assembly 120 (and the main screed 136) is floatingly pulled by the paving machine 100 over the paving material. The main screed plate 144 may be comprised of a single plate or a plurality of connected plate sections. The screed assembly 120 may also include a tamper device 146 positioned forward of the screed plate 144. The tamper device 146 extends transversely to the direction of travel of the road paver 100. In addition, the screed assembly 120 may include a walkway 148 for an operator to have a better access to the surface being paved in order to assess the quality of the paving operation or for any other purpose. The screed assembly 120 of paving machine 100 may include additional components and systems, such as, for example, leveling arms, vibrators, sensors, and controllers, as are known to those skilled in the art. Such additional systems and components are not within the scope of the present disclosure and, thus, will not be discussed herein in greater detail.

Figure 3:
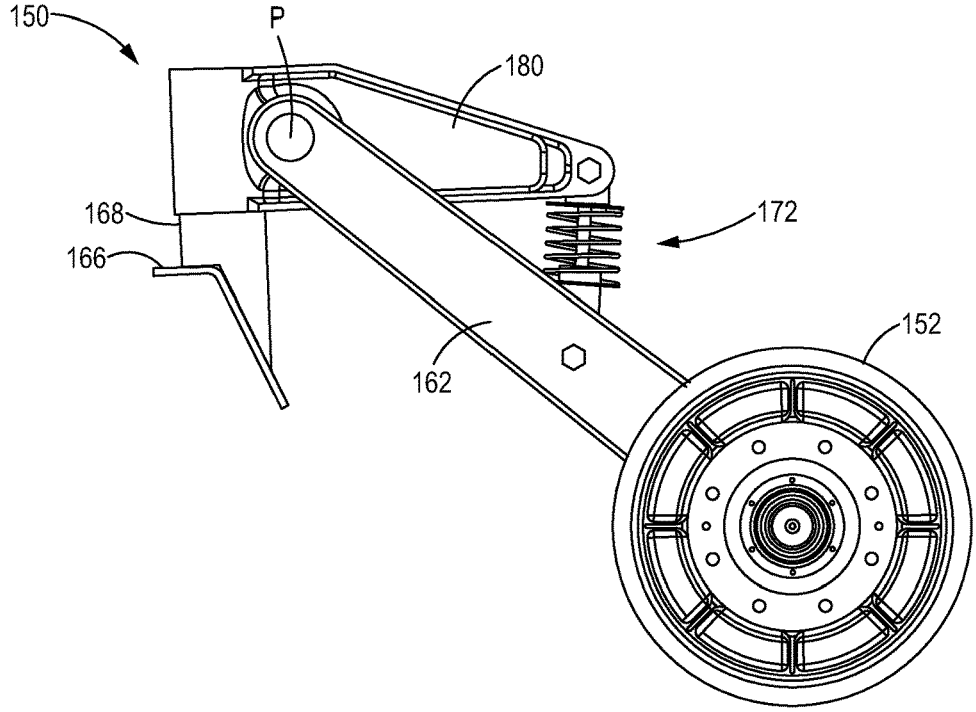
FIG. 3 is a side view of the overload support system of FIG. 1 in a lowered position, in accordance with the present disclosure.
Figure 4:
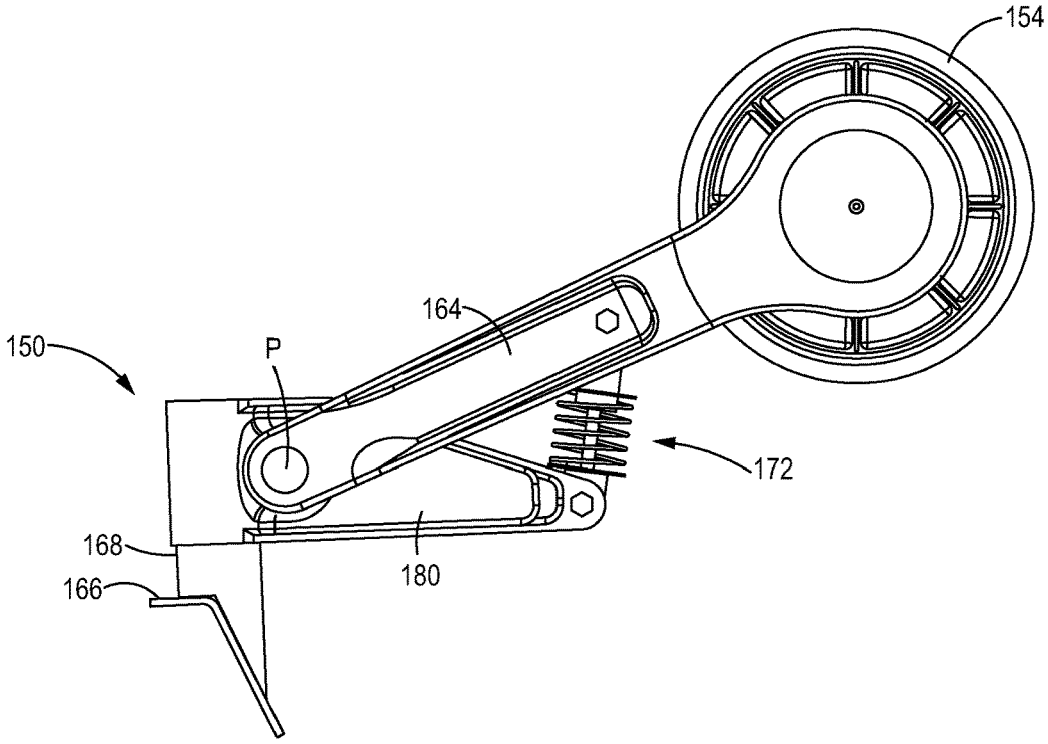
FIG. 4 is another side view of the overload support system of FIG. 1 in a raised position, in accordance with the present disclosure.

FIGS. 1 and 2 also illustrate an overload support system 150 for the screed assembly 120. The exemplary embodiment of the overload support system 150 of FIGS. 1 and 2 includes two adjustable overload wheels 152, 154 mounted to and extending from opposite sides of the screed assembly 120. FIGS. 3 and 4 illustrate the overload support system 150 independent of the screed assembly 120. As depicted, the two overload wheels 152, 154, as well as the additional overload support system 150 structure, may be substantially identical, mirror images of each other. In FIGS. 1-3, one side of the adjustable overload support system 150 including wheel 152 is shown in a lowered position and in contact with a surface 160 extending beneath the screed assembly 120. And for illustrative purposes, in FIGS. 1, 2 and 4, the other side of the adjustable overload support system 150 including wheel 154 is shown in a raised position and far from any contact with the surface 160. As will be explained in detail below, during a paving operation, the overload wheels 152, 154 will typically both be locked in the raised position; and during transport of the paving machine to another worksite or otherwise, the overload wheels 152, 154 will typically both be locked in the lowered position, thereby supporting the screed assembly 120 during travel. While the overload support system is illustrated here as including wheels 152, 154, alternatively, other rotatable members such as tracks could be used, or any combination thereof capable of supporting the screed assembly 120 during travel. Also, while the paving machine 100 may primarily be transported on relatively smooth, flat surfaces 160, the disclosed overload support systems 150 and methods are functional on any surfaces 160, including asphalt, concrete, dirt, gravel, sand, soil, etc.

The overload wheels 152, 154 may be mounted in any number of manners known in the industry to arms 162, 164 extending from the screed assembly 120. While the wheels 152, 154 are illustrated as trailing wheels, contemplated herein are other configurations, such as but not limited to, pivoting wheels, oscillating wheels, caster wheels capable of 360-degree turns, etc. Also contemplated herein, the wheels 152, 154 may be enhanced, for example, with a steering linkage, or in any other number of manners known in the industry. FIGS. 3 and 4 illustrate opposite sides of the wheels 152, 154 and the arms 162, 164 of the overload support system 150. In this exemplary embodiment, the arms 162, 164 extend from a bracket structure 166 that is mounted directly to the screed assembly 120. Such a bracket structure 166 may be mounted to the screed assembly 120 using any number of attachment means common in the industry, including but not limited to, bolts, screws, anchors, nails, clips, pins, staples, etc. The bracket structure 166 may incorporate a vertical support member 168 extending upwardly from the bracket structure 166, which may connect directly or indirectly with the arms 162, 164. The arms 162, 164 may pivot about point P thereby allowing for the lowered (FIG. 3) or the raised (FIG. 4) positions. Attachment of the arm 162 at pivot point P may be to the bracket structure 166, the vertical support member 168 or another structural component of the overload support system 150; and any number of adjustable attachment means known in the industry may be employed for this attachment, whether pivotable or otherwise. While the bracket structure 166 is depicted as having two relatively flat sides attached directly to the extension screed 138, it should be understood that the bracket structure 166 may be of any shape or form, and may be mounted to any component of the screed assembly 120. Alternatively, the arms 162, 164 may be adjustably mounted directly to the screed assembly 120.

The exemplary embodiment of the overload support system 150 depicted in FIGS. 1-4 includes a spring over shock strut assembly 172. A spring over shock strut assembly 172 may also be known as a coil spring over shock absorber, the specifics of which are commonly understood in the industry and will therefore not be described in detail herein. These assemblies are commonly used to improve suspension and absorb impact. FIGS. 2-4 depict most clearly the spring over shock strut assembly 172 of the overload support system 150. With reference to FIGS. 2 and 3, the spring over shock strut assembly 172 may be pivotally mounted at both ends between the arm 162 and a relatively horizontally extending support member 180, which may be attached to and extend from the bracket structure 166 or from the vertical support member 168. This pivotal attachment of the spring over shock strut assembly 172 at both ends may be by any attachment means common in the industry. The arm 162 may extend directly from the horizontally extending support member 180 and pivot thereabout at point P, as illustrated. Further, as most clearly illustrated in FIG. 2, the arm 162 includes an elongated opening 184 wherein the spring over shock strut assembly 172 is received. Specifically, a first end of the spring over shock strut assembly 172 may be pivotally mounted to the horizontally extending support member 180, while a second end of the spring over shock strut assembly 172 may be pivotally mounted in the elongated opening 184 of the arm 162. The configuration between the opposite arm 164 and its associated spring over shock strut assembly 172 may be substantially the same.

As further illustrated in FIGS. 2-4, this configuration allows for both the raised and lowered positions of the overload support system 150. Specifically, when in the lowered position (FIG. 3), the arm 162 and wheel 152 extend downwardly and the spring over shock strut assembly 172 is disposed above the arm 162. Alternatively, when in the raised position (FIG. 4), the arm 164 and wheel 154 extend upwardly and the spring over shock strut assembly 172 is disposed below the arm 164. The pivotal mounting of both ends of the spring over shock strut assembly 172 to the horizontal support member 180 and the arm 162, 164 facilitates movement between the lowered and raised positions. Specifically, when raising and lowering the arms 162, 164 about pivot point P, the spring over shock strut assembly 172 may compress and pivot at both ends, while the horizontal support member 180 remains stationary. As such, both the spring over shock strut assembly 172 and the horizontal support member 180 pass through the elongated opening 184 when raising and lowering the arms 162, 164, or switching the overload support system 150 between paving operational and travel positions, respectively. While not illustrated, it should be understood that any configuration that incorporates a spring over shock strut assembly in the overload support system 150 is contemplated herein.

Figure 5:
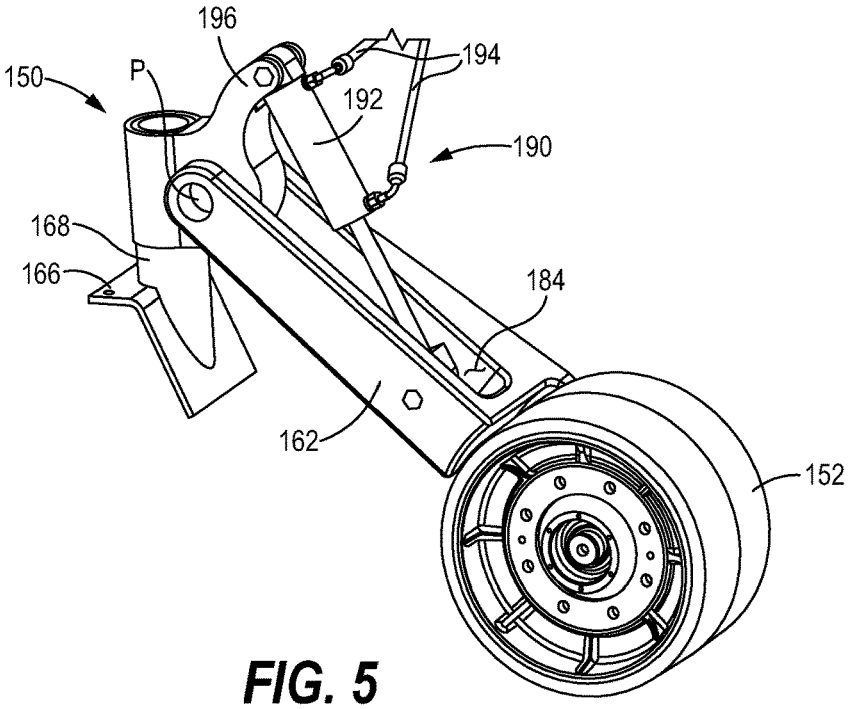
FIG. 5 is a perspective view of another exemplary overload support system for a screed assembly that may be used in conjunction with the paving machine of FIG. 1, in accordance with the present disclosure.

FIG. 5 illustrates another exemplary embodiment of the overload support system 150. Similar to the overload support system of FIGS. 1-4, this embodiment may also include the bracket structure 166 for mounting the overload support system 150 to the screed assembly 120, as well as and the vertical support member 168. Further, this embodiment may include arm 162 pivotally attached at point P, the arm 162 including the elongated opening 184 therein. Likewise, attachment of the arm 162 at pivot point P, may be to the bracket structure 166, the vertical support member 168 or to another structural component of the overload support system 150. However, rather than including a spring over shock strut assembly 172, the overload support system 150 of FIG. 5 is adapted with a shock absorbing hydraulic cylinder assembly 190, the specifics of which are commonly understood in the industry and will therefore not be described in detail herein. Such hydraulic cylinder assemblies are routinely employed to absorb impact. Impact may be absorbed in the accumulator 192 of the hydraulic cylinder assembly 190, as commonly understood in the industry. The hydraulic cylinder assembly 190 may also be adapted with hydraulic lines 194 to for supplying hydraulic fluid pumped to and from the accumulator 192, as also commonly understood in the industry. This configuration may also allow for operator-automated, as opposed to manual, adjustment of the overload support system 150 between lowered and raised positions. While not illustrated, the hydraulic cylinder assembly 190 may further include a spring element.

As depicted in FIG. 5, the hydraulic cylinder assembly 190 may be pivotally mounted at both ends between the arm 162 and a relatively upwardly extending support member 196, which may be attached to and extend from the bracket structure 166 or from the vertical support member 168. The arm 162 may extend directly from the upwardly extending support member 196 and pivot thereabout at point P, as illustrated. Further, as clearly illustrated in FIG. 5, the elongated opening 184 in the arm 162 receives the hydraulic cylinder assembly 190. Specifically, a first end of the hydraulic cylinder assembly 190 may be pivotally mounted to the upwardly extending support member 196, while a second end of the hydraulic cylinder assembly 190 may be pivotally mounted in the elongated opening 184 of the arm 162. Like the embodiment of FIGS. 1-4, this embodiment may also be employed in double, mounted to opposite sides of the screed assembly 120.

The exemplary embodiment of FIG. 5 allows for both the raised and lowered positions of the overload support system 150. Specifically, as illustrated in FIG. 5, when in the lowered position, the arm 162 and wheel 152 extend downwardly and the hydraulic cylinder assembly 190 is extended. Alternatively, when in the raised position (not shown), the arm 162 and wheel 152 may extend upwardly while the hydraulic cylinder assembly 190 is compressed, partially within the elongated opening 184. The pivotal mounting of both ends of the hydraulic cylinder assembly 190 to the upwardly extending support member 196 and the arm 162 facilitates movement between the lowered and raised positions. Specifically, when raising and lowering the arm 162 about pivot point P, the hydraulic cylinder assembly 190 may compress or extend and pivot at both ends, while the upwardly extending support member 196 remains stationary. As such, the arm 162 and wheel 152 may be raised or lowered, switching the overload support system 150 between paving operational and travel positions, respectively. While not illustrated, it should be understood that any configuration that incorporates a hydraulic cylinder assembly in the overload support system 150 is contemplated herein.

Figure 6:
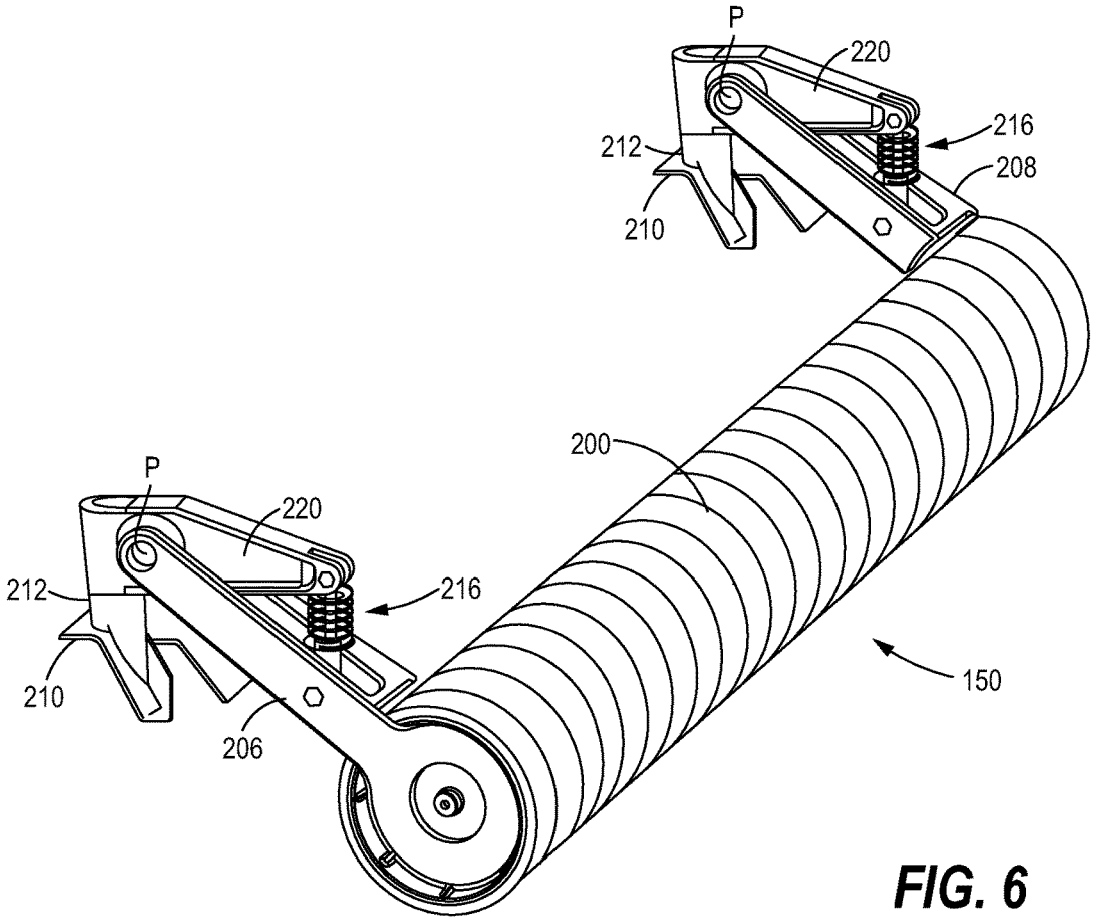
FIG. 6 is a perspective view of another exemplary overload support system for a screed assembly that may be used in conjunction with the paving machine of FIG. 1, in accordance with the present disclosure.

Turning to an additional exemplary embodiment of the disclosure, FIG. 6 illustrates the overload support system 150 having an elongated roller 200 disposed between two arms 206, 208. As opposed to the embodiments of FIGS. 1-5, which may include two identical support systems mounted to opposite sides of the screed assembly 120, this embodiment of the overload support system 150 may be a single, integrated unit centrally mounted to the rear of the screed assembly 120. The two arms 206, 208 of this embodiment may be mounted to the screed assembly 120 in a similar manner and include similar shock absorbing assemblies as described above with reference to FIGS. 1-5. Specifically, as illustrated, this overload support system 150 may include two arms 206, 208 extending from a bracket structure 210, a vertical support member 212 or from another structural component of the overload support system 150. Likewise, the overload support system 150 of FIG. 6 may include spring over shock strut assemblies 216 for shock absorption, which extend between arms 206, 208 and horizontal support members 220. Alternatively, this embodiment may include hydraulic cylinder assemblies 190 for shock absorption, as described above with reference to FIG. 5. Moreover, like the above-described embodiments, the overload support system 150 of FIG. 6 may pivot at points P between a lowered position (as shown) and a raised position. The elongated roller 200 may be one elongated wheel or a series of adjacent wheels. Alternatively, the elongated roller 200 may include a rotatable drum or track, or any other suitable member that can support the screed assembly 120 during transport. Also contemplated herein is an embodiment wherein the two arms 206, 208 merge to form a single mounting configuration for attaching the overload support system 150 to the rear center of the screed assembly 120. Any number of mounting configurations or fasteners known in the industry may be employed to attach this overload support system 150 to the screed assembly 120. Further, depending on the screed assembly, the overload support system 150 may be mounted at any suitable location on the screed assembly, including the main screed 136, the extension screed 138 or the walkway 148.

With regard to all the disclosed and contemplated embodiments, whether in the raised or lowered position, the overload support system 150 may be locked in place using any manner of securing mechanisms known in the industry, including bolts, screws, anchors, nails, clips, pins, staples, etc. For example, a bolt at pivot point P may be used to secure the arms 162, 164, 206, 208 in a raised or lowered position. Alternatively, any latch or fastener known in the industry may be employed to maintain the desired position. Such a latch or fastener may extend between elements of the overload support system 150, or between the overload support system 150 and the screed assembly 120. In addition, locking and/or unlocking the overload support system 150 may be performed manually, or may be automated using any number of manners known in the industry. Further, other or additional shock absorbing components known in the industry may be incorporated in any of the disclosed overload support systems 150. Alternatively, while the depicted embodiments include advantageous shock absorbing components (i.e., spring over shock strut assembly 172 and hydraulic cylinder assembly 190), shock-absorbing components are not required. For example, the arms 162, 164, 206, 208 may pivot between raised and lowered positions, and function properly regardless of any shock absorbing components. Also contemplated herein is an overload support system 150 permanently fixed in a lowered position. Such a configuration may include nonadjustable arms attached to a bracket or other structure, or directly to the screed assembly. In such a configuration, the arms may not pivot about a point P to raise or lower the overload support system 150, as described above. Instead, before the paving machine travels between worksites or otherwise travels for non-paving purposes, personnel may mount the fixed overload support system to the screed assembly to support the same during travel. Embodiments are further contemplated herein having the wheel elements alone of the overload support system that are adapted to pivot upwardly. Otherwise, a fixed overload support system may be dismounted from the screed assembly before paving operations commence.

Furthermore, the adjustable overload support system 150 may be permanently or temporarily attached to the screed assembly. For example, the overload support system 150 may be removably bolted, or otherwise securely fastened using any manner known in the industry, directly or indirectly to the screed assembly 120. In this manner, the overload support system 150 may be removed from the screed assembly when necessary, for maintenance or otherwise. Alternatively, the overload support system 150 may be welded, or otherwise permanently attached, to the screed assembly 120. Moreover, existing screeds may be retrofitted with the disclosed overload support systems 150, whether removably or permanently attached thereto. In addition, while FIGS. 1 and 2 depict the overload support system 150 as attached to the extension screeds 138, one with skill in the art will understand that the overload support system 150 may be attached anywhere on the screed assembly 120, including but not limited to, the main frame 134, the main screed 136 or the walkway 148. In any such embodiments, the overload support system 150 need only extend sufficiently to contact the surface 160 extending beneath the screed assembly 120, and thereby support the screed assembly 120 during travel. Further, while FIGS. 1-5 illustrate an overload support system 150 having arms 162, 164 and wheels 152, 154 that extend in a rearward direction, also contemplated herein is an overload support system that extends laterally from opposite sides the screed assembly 120. Also contemplated herein, all of the disclosed adjustable overload support systems 150 may be moved between lowered and raised positions manually, or may be adapted with means for operator-automated adjustment of their position, including any type of mechanic, hydraulic or electrical actuators known in the industry.

Figure 7:
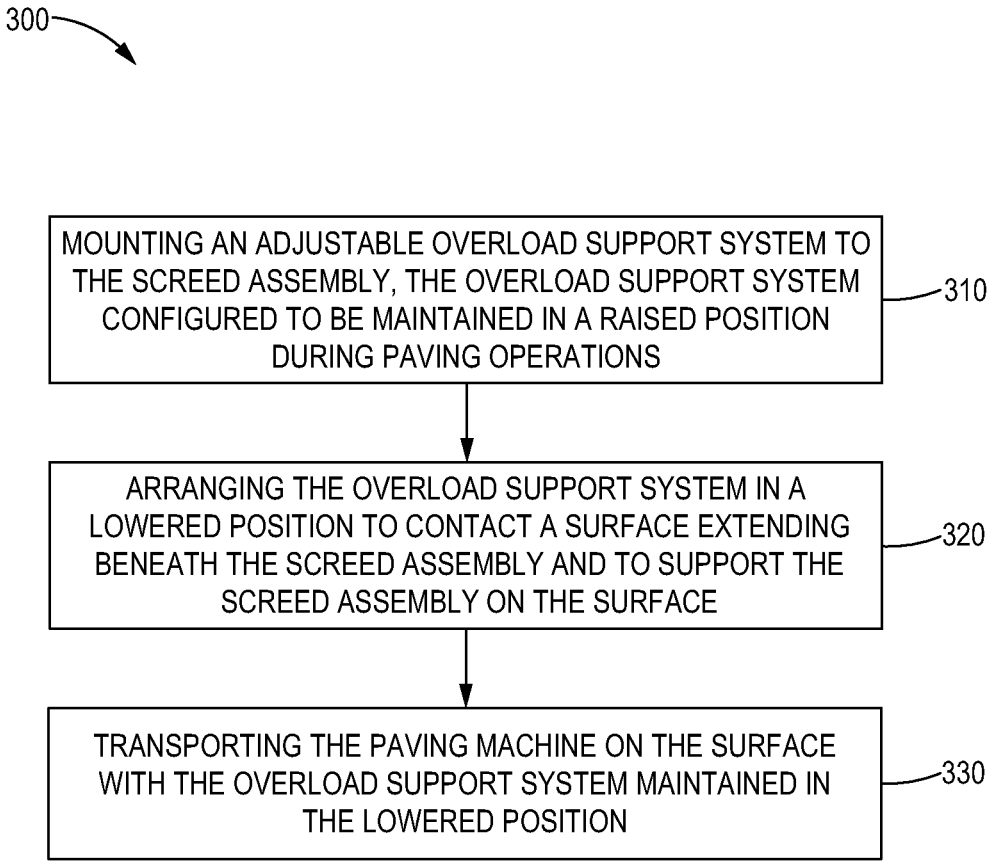
FIG. 7 is a flow chart for a method of transporting a paving machine having a screed assembly, in accordance with the present disclosure.

FIG. 7 shows a flow chart for a method of transporting a paving machine having a screed assembly. FIG. 7 is discussed in more detail in the following section to further illustrate the disclosed methods and concepts.

INDUSTRIAL APPLICABILITY

The disclosed overload support systems 150 may be integrated where needed with any number of mobile work machines including, but not limited to, paving equipment, earth-moving equipment, mining machines and other construction or agriculture machinery. With regard to paving machines 100, the many components of screed assemblies 120 may contribute excessive weight on the rear end of the paving machine 100. While conventional paving machines may be able to raise and support the substantial weight of the screed assembly during a paving operation, travel of the paving machine between worksites or otherwise may be difficult, if not impossible. Heavy counterweights, such as ballast counterweight, mounted to the front end of paving machines have typically been used to counterbalance the significant weight of an attached screed assembly; however, this solution is both burdensome and adds extra weight to a perhaps already overloaded paving machine. By incorporating the overload support system 150 of the present disclosure on the screed assembly 120 of a paving machine 100, the imbalance between the front and rear ends of the paving machine 100, as well as any risks such an imbalance may present during transport of the paving machine 100, may be avoided.

Turning to FIG. 7, a flow chart for a method 300 of transporting a paving machine having a screed assembly is shown. The disclosed method 300 begins with, at step 310, mounting an adjustable overload support system 150 to the screed assembly 120, the overload support system 150 configured to be maintained in a raised position during paving operations. As described with reference to FIGS. 1-6, the overload support system 150 may include wheels 152, 154, 200 or other suitable members extending from arms 162, 164, 206, 208 mounted to the screed assembly 120. FIGS. 1 and 2 illustrate both the raised and lowered positions of the overload support system 150. Specifically, the wheel 152 and arm 162 are illustrated in the raised position, while the wheel 154 and arm 164 are illustrated in the lowered position. The overload support systems 150 are illustrated in their alternate positions in FIGS. 1 and 2 for illustrative purposes only. Whatever the operation, relocating the paving machine 100, or using the paving machine 100 for a paving operation, the wheels 152, 154 and arms 162, 164 of the overload support system 150 will typically be maintained in identical positions.

With further regard to step 310, the overload support system 150 may include two or more separate support systems mounted on opposite sides of the screed assembly 120 (as illustrated in FIGS. 1 and 2). Alternatively, as described above with reference to FIG. 6, the overload support system 150 may be a single unit mounted at the center rear of the screed assembly 120. The overload support system 150 may include various structural components, as described above, and may be mounted directly or indirectly to the screed assembly 120 using any attachment manner known in the industry. As also illustrated and described above, the arms 162, 164, 206, 208 of the overload support system 150 may pivot about point P so as to enable the adjustment of the overload support system 150 between the raised and lowered positions. As such, the overload support system 150 may be maintained in the raised position during paving operations. In this manner, the overload support system 150 does not interfere with the laying and compacting of the asphalt or other paving material on the surface 160.

The disclosed method 300 of transporting a paving machine having a screed assembly further requires, at step 320, arranging the overload support system 150 in a lowered position to contact a surface 160 extending beneath the screed assembly 120 and to support the screed assembly 120 on the surface 160. Specifically, as described above, the overload support system 150 may pivot at point P between the raised position maintained during paving operations and an extended, lowered position that supports at least a portion of the screed assembly 120 weight on the surface 160. Further, as illustrated in FIGS. 1-6, the overload support system 150 includes structural components along with wheels 152, 154, 200 or other suitable members that support the screed assembly 120 on the surface 160. In this manner, the overload support system 150 helps to correct the weight imbalance between the front of the paving machine 100 and the screed-carrying rear of the paving machine 100. Movement of the overload support system 150 from the raised position maintained during paving operations to the lowered position may be performed manually by personnel, or may be initiated remotely by an operator of the paving machine 100. Any type of mechanic, hydraulic or electrical actuator known in the industry may be incorporated in the overload support system 150 for such a non-manual adjustment between the raised and lowered positions. Further, while the adjustable overload support system 150 is illustrated as adjustable about pivot point P, other pivot points or locations for adjustment are encompassed in the present disclosure, for example, a pivot point or adjustment that raises and lowers the wheels 152, 154, 200 alone while the arms 162, 164, 206, 208 remain substantially stationary.

With further regard to the disclosed method 300 of transporting a paving machine having a screed assembly, step 330 requires transporting the paving machine 100 on the surface 160 with the overload support system 150 maintained in the lowered position. As explained herein, transportation of a conventional paving machine having a screed assembly attached thereto may be difficult due to the heavy weight of the screed assembly. The overload support system 150 presently disclosed addresses this problem by providing support for the screed assembly 120 during transport of the paving machine 100, independent of paving operations. This transport may include travel between worksites, travel to and from storage facilities, travel for maintenance, etc. As illustrated in FIGS. 1-6, wheels 152, 154, 200 or other suitable members support the screed assembly 120 and may move therewith on the surface 160 to support the screed assembly 120 throughout transport of the paving machine 100. The method 300 may further include locking or fastening the overload support system 150 in either the raised or lowered position for paving operations or travel, respectively. Likewise, adjusting the overload support system 150 between its raised or lowered position may include unlocking or unfastening the overload support system from a securely maintained position. The disclosed overload support system 150 may incorporate any shock absorption assemblies known in the industry, such as but not limited to, a spring over shock strut assembly 172 or a hydraulic cylinder assembly 190. These assemblies are commonly employed in the industry to improve suspension and absorb impact. As such, the paving machine 100 may be transported more efficiently, with less impact on both the paving machine 100 and the screed assembly 120, thereby potentially reducing damage to the paving machine 100, as well as additional maintenance costs.

While the above-described method 300 pertains to an adjustable overload support system 150, also disclosed herein are fixed overload support systems 150 that are mounted to a screed assembly 120 prior to transportation of the paving machine 100, and thereafter removed so as not to interfere with paving operations. Such a configuration requires temporary mounting of the overload support system 150, as opposed to permanent mounting, which is also contemplated herein. Further, should a temporarily mounted, adjustable or fixed overload support system 150 become damaged, it may easily be replaced with a new overload support system 150 adapted for mounting onto the screed assembly 120. Moreover, should access to the screed assembly 120 for maintenance or otherwise be required, temporarily mounted overload support systems 150 may be removed for that purpose. In addition, all of the presently disclosed overload support systems 150 offer the advantage of being mountable to any existing screed assembly 120 in the industry. As such, any paving machine 100 having a screed assembly 120 may incorporate the disclosed overload support systems 150 and thereby correct any disadvantageous front/rear weight imbalance. Accordingly, also contemplated herein is a kit including the overload support system 150, as well as any attachment means required for mounting the overload support system 150 to an existing screed 120. Retrofitting existing paving machines 100, or adapting screed assemblies 120 generally, with overload support systems 150 may therefore avoid overburdening the paving machine 100 with ballast counterweight, improve steering and handling of the paving machine, and reduce impact on both the paving machine 100 and the screed assembly 120, all of which may contribute to an overall increase in the efficiency of their transport. Moreover, mounting of the disclosed adjustable or fixed overload support systems 150, as well as adjustment of the same between raised and lowered positions, may be easily performed onsite by personnel or the machine operator, therefore avoiding the need for any additional machinery or equipment, for example, to install ballast or to correct the weight imbalance of the paving machine by any other manner.

All references to the disclosure or examples thereof are intended to reference the particular example being discussed at that point and are not intended to imply any limitation as to the scope of the disclosure more generally. Also, it will be apparent to those skilled in the art that various modifications and variations can be made to the overload support system of the present disclosure without departing from the scope of the disclosure. Other embodiments will be apparent to those skilled in the art from consideration of the specification and practice of the embodiments disclosed herein. It is intended that the specification and examples be considered as exemplary only, with a true scope of the disclosure being indicated by the following claims.

What is claimed is:

1. A screed assembly for a paving machine, the screed assembly comprising:
- a main frame;
- a main screed;
- a screed plate; and
- an overload support system including
  - a bracket structure mounted on the screed assembly,
  - a vertical support member that extends upwardly from the bracket structure,
  - a wheel configured to contact a surface extending beneath the screed assembly when the overload support system is in a lowered position, and
  - an arm configured to allow the lowered position, the arm being attached, at a pivot point, to the bracket structure or the vertical support member.

2. The screed assembly of claim 1, wherein the overload support system is adjustable between a raised position and the lowered position.

3. The screed assembly of claim 2, wherein adjustment of the overload support system between the raised position and the lowered position is automated.

4. The screed assembly of claim 1, wherein, when the overload support system is adjusted between a raised position and the lowered position, the wheel moves in a plane perpendicular to a widthwise direction of the screed assembly.

5. The screed assembly of claim 1, wherein the overload support system comprises two overload support systems mounted on opposite sides of the screed assembly.

6. The screed assembly of claim 1, wherein the overload support system comprises a single overload support system mounted on a rear of the screed assembly.

7. The screed assembly of claim 1, wherein the overload support system comprises a shock absorbing assembly.

8. The screed assembly of claim 1, wherein the screed assembly is mounted to the paving machine, the paving machine including a machine frame, a plurality of traction devices, a power source, and a hopper.

9. The screed assembly of claim 1, wherein the overload support system further includes:

a spring over shock strut assembly that is pivotally mounted between the arm and a relatively horizontally extending support member that extends from the bracket structure.

* * * * *